US006954177B2

(12) United States Patent
Channabasappa et al.

(10) Patent No.: US 6,954,177 B2
(45) Date of Patent: Oct. 11, 2005

(54) MICROSTRIP ANTENNA ARRAY WITH PERIODIC FILTERS FOR ENHANCED PERFORMANCE

(75) Inventors: Eswarappa Channabasappa, Acton, MA (US); Frank Kolak, Billerica, MA (US); Richard Alan Anderson, Attleborough, MA (US)

(73) Assignee: M/A-COM, Inc., Lowell, MA (US)

( * ) Notice: Subject to any disclaimer, the term of this patent is extended or adjusted under 35 U.S.C. 154(b) by 58 days.

(21) Appl. No.: 10/289,874

(22) Filed: Nov. 7, 2002

(65) Prior Publication Data

US 2004/0090368 A1 May 13, 2004

(51) Int. Cl.[7] ..... H01Q 1/38

(52) U.S. Cl. ..... 343/700 MS; 343/909; 343/846

(58) Field of Search ..... 343/700 MS, 756, 343/909, 853, 846, 848

(56) References Cited

U.S. PATENT DOCUMENTS

| | | | | |
|---|---|---|---|---|
| 4,937,972 A | | 7/1990 | Huang | 343/700 |
| 5,045,862 A | * | 9/1991 | Alden et al. | 343/700 MS |
| 5,068,669 A | * | 11/1991 | Koert et al. | 343/700 MS |
| 5,448,249 A | * | 9/1995 | Kushihi et al. | 343/700 MS |
| 5,896,104 A | | 4/1999 | Komatsu et al. | 342/175 |
| 5,912,645 A | * | 6/1999 | Wight et al. | 343/700 MS |
| 6,313,797 B1 | * | 11/2001 | Kurita et al. | 343/700 MS |
| 6,466,172 B1 | * | 10/2002 | Ryken et al. | 343/700 MS |
| 6,529,092 B2 | * | 3/2003 | Fuke et al. | 333/99 S |
| 6,630,907 B1 | * | 10/2003 | Ryken et al. | 343/700 MS |
| 6,774,867 B2 | * | 8/2004 | Diaz et al. | 343/909 |

OTHER PUBLICATIONS

Dan Sievepiper, Member, IEEE, Lijun Zhang, Romulo F. Jimenez Broas, Nicholas G. Alexopolous, Fellow, IEEE, and Eli Yablonovitch, Fellow, IEEE High–Impedance Electromagnetic Surfaces with a Forbidden Frequency Band, IEEE Transactions on Microwave Theory and Techniques, vol. 47, No. 11, Nov., 1999.

Marc Thevenot, Cyril Cheype, Alain Reineix, and Bernard Jecko, Member IEEE, Directive Photonic–Bandgap Antennas, IEEE Transactions on Microwave Theory and Techniques, vol. 47, No. 11, Nov., 1999.

(Continued)

*Primary Examiner*—Tan Ho

(57) ABSTRACT

An antenna unit formed in the shape of a hollow box comprising (a) a substrate forming the front side of the antenna unit, (b) a first microstrip antenna array formed on the substrate, (c) a second microstrip antenna array formed on the substrate, (d) a ground plane forming the rear side of the antenna unit, and (e) a plurality of periodic filters formed on the ground plane. The periodic filters are formed by etching a series of circular patterns, or holes, through the ground plane. The periodic stop band filters provide for improved isolation between the microstrip antenna arrays, without the need for adding additional costly or space consuming components.

25 Claims, 4 Drawing Sheets

OTHER PUBLICATIONS

Ramon Gonzalo, Student Member, IEEE, Peter De Maagt, Member, IEEE and Mario Sorolla, Member, IEEE, Enhanced Patch–Antenna Performance by Suppressing Surface Waves Using Photonic–Bandgap Substrates, IEEE Transactions on Microwave Theory and Techniques, vol. 47, No. 11, Nov., 1999.

Vesna Radisic, Student Member, IEEE, Yongxi, Member, IEEE, Roberto Coccioli, Member, IEEE, and Tatsuo Itoh, Life Fellow, IEEE, Novel 2–D Photonic Bandgap Structure for Microstrip Lines, IEEE Microwave and Guided Wave Letters, vol. 8, No. 2, Feb., 1998.

Fan Yang et al: Mutual Coupling Reduction Of Microstrip Antennas Using Electromagnetic Band–Gap Structure, IEEE Antennas And Propagation Society International Symposium, 2001 Digest, APS. Boston, MA, Jul. 8–13, 2001, pp. 478–481, XPO10564130.

Lee Y et al: Institute of Electrical And Electronics Engineers: "Multi–Layer Spatial Angular Filter With Air Gap Tuner To Suppress The Grating Lobes Of Microstrip Patch Arrays" Jun. 2–7, 2002, pp. 1329–1332, XPOO11100006.

Leong, K M K H et al: "Coupling Suppression In Microstrip Lines Using A Bi–Periodically Perforated Ground Plane", May 5, 2002, pp. 169–171, XPOO1114925.

* cited by examiner

MICROSTRIP ANTENNA ARRAY WITH PERIODIC FILTERS FOR ENHANCED PERFORMANCE

FIELD OF THE INVENTION

The present invention relates to antennas, and more specifically to microstrip antenna arrays enhanced with periodic filters.

BACKGROUND OF THE INVENTION

The use of complex electronic systems in automobiles has increased dramatically over the past several years. Radar systems have been used in advanced cruise control systems, collision avoidance systems, and hazard locating systems. For example, systems are available today that inform the driver if an object (e.g. child's bicycle, fire hydrant) is in the vehicle's path even if the object is hidden from the driver's view.

Systems such as these utilize small radar sensor modules that are mounted somewhere on the automobile (e.g., behind the front grill, in the rear bumper). The module contains one or more antennas for transmitting and receiving radar signals. These devices work by transmitting radio frequency (RF) energy at a given frequency. The signal is reflected back from any objects in its path. If any objects are present, the reflected signal is processed and an audible signal is sounded to alert the driver. One example of this type of radar system is the 24 GHz High Resolution Radar (HRR) developed by M/A-Com Inc. (Lowell, Mass.).

The radar sensor units used in these systems typically utilize two independent antenna arrays. A first array is used to transmit the outbound signals, and a second antenna array is used to receive the reflected return signals. The two antenna arrays are formed on a single substrate and are generally separated by a space of three to four inches.

Microstrip antenna arrays are often used in this type of application because they have a low profile and are easily manufactured at a low cost. In addition, microstrip antenna arrays are versatile and can be used in applications requiring either directional or omni-directional coverage. Microstrip antenna arrays operate using an unbalanced conducting strip suspended above a ground plane. The conductive strip resides on a dielectric substrate. Radiation occurs along the strip at the points where the line is unbalanced (e.g., corners, bends, notches, etc.). This occurs because the electric fields associated with the microstrip along the balanced portion of the strip (i.e., along the straight portions) cancel one another, thus removing any radiated field. However, where there is no balance of electric fields, radiation exists. By controlling the shape of the microstrip, the radiation properties of the antenna can be controlled.

Slot-coupled microstrip antennas arrays comprise a series of microstrip patch antennas that are parasitically coupled to a feed microstrip. The feed microstrip resides below the ground plane and is coupled to each of the patch microstrips through a slot in the ground plane. Various numbers of patch antennas can be coupled to a single microstrip input feed to form the array. Six-element arrays and eight-element arrays are commonly used in High Resolution Radar (HRR) sensors, although any number of patch elements can be coupled to the feed microstrip.

One problem that arises using this type of antenna design is that the transmit and receive antenna arrays are not perfectly isolated from each other. There is some level of RF signal leakage between the two antenna arrays, either through the air or through the substrate material. The leakage through the substrate is caused by undesired surface wave propagation. This coupling effect between the two antenna arrays lowers antenna gain and reduces performance of the radar sensor.

Presently, several techniques are used to improve isolation between microstrip array antennas. Two techniques are shown in FIG. 1. The first technique, shown in FIG. 1*a*, involves placing a metal wall 11 in the antenna unit 10 between the transmitting antenna array 13 and receiving antenna array 15. The metal wall 11 improves the isolation between the two microstrip array antennas by blocking or reflecting back signals passing through the air within the cavity 17 formed within the antenna unit 10. While using a wall 11 such as this will improve isolation between the two antennas, it has several drawbacks. First, the addition of a metal wall 11 in the antenna unit 10 consumes additional space and is cumbersome. As antenna units are becoming increasingly smaller, it is undesirable to introduce an additional space consuming component. Secondly, the isolation achieved by inserting the metal wall 11 is not as high as desired (only about 4 dB improvement in the isolation is obtained). Much of the signal leakage occurs through the substrate rather than by radiated signals traveling through the air within the antenna unit 10. The metal wall 11 does not sufficiently block any signal coupling which occurs via the substrate layer.

A second technique used to provide isolation is illustrated in FIG. 1*b*. This technique involves placing a section 12 of a signal absorbing material in the cavity 18 formed between the transmitting antenna 14 and the receiving antenna 16 within the antenna unit 20. For example, a section 12 of Eccosorb GDS sheet (Emerson & Cuming Microwave Products, Inc., Randolph, Mass.) can be placed between the antennas to absorb radiation within the unit 20 and thus improve isolation between the antennas. However, this technique also has limitations. While the absorbing materials such as Eccosorb GDS provide an improvement in isolation over the metal wall (about 8 dB improvement in the isolation is obtained), the isolation is not as complete as desired. In addition, the absorbing materials are high in cost.

Despite attempts to improve isolation between antennas within an antenna unit using these techniques, often the level of isolation achieved proves to be insufficient. Accordingly, there is a need for an antenna unit that provides a high level of isolation between the antennas, while at the same time is compact, cost efficient, and achieves a high level of gain. The present invention fulfills these needs among others.

SUMMARY OF THE INVENTION

The present invention provides an antenna unit that improves isolation between a plurality of microstrip antenna arrays while also increasing the radiation gain of each antenna array. This is accomplished by etching a series of openings into the ground plane of an antenna unit comprising at least one slot coupled microstrip antenna array. The openings are configured in such a manner as to act as periodic stop band filters between the antennas. The filters suppress the surface waves propagating from each antenna array, thus increasing the gain of each respective slot coupled microstrip antenna array and the isolation (between two antenna arrays).

The openings are arranged in a series of rows and columns. The configuration and positioning of the openings in the ground plane determines the characteristics of the filter.

The consistent spacing between the openings results in the periodic nature of the filters with the frequency of the stop band depending upon the spacing chosen. The width of the stop band is determined by the area of the openings.

One aspect of the present invention is an automotive sensor unit comprising two microstrip antenna arrays wherein the microstrip antenna arrays have a measured isolation with respect to each other of at least −30 dB in the frequency bandwidth of operation for an HRR sensor (22 to 26 GHz). More preferably, a measured isolation of the antenna arrays with respect to each other of at least −40 dB, or even more preferably of at least −50 dB, can be obtained. In a preferred embodiment, the antenna unit is formed in the shape of a hollow box, and comprises (a) a substrate forming the front side of the antenna unit, (b) a first microstrip antenna array formed on the substrate, (c) a second microstrip antenna array formed on the substrate, (d) a ground plane forming the rear side of the antenna unit, and (e) a plurality of periodic filters formed on the ground plane. The periodic filters are formed by most easily formed etching a series of circular patterns, or holes, through the ground plane. Openings of various other shapes can also be used to produce the filters. The periodic stop band filters provide for improved isolation between the microstrip antenna arrays, without the need for adding additional costly or space consuming components.

DETAILED DESCRIPTION OF THE INVENTION

Figure 1A:
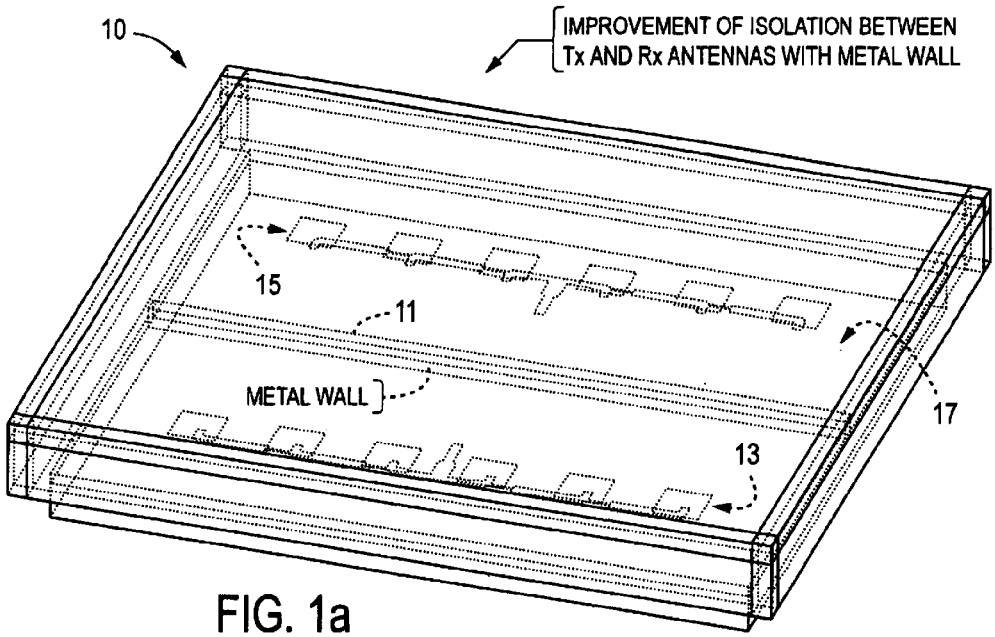
FIG. 1a PRIOR ART
FIG. 1*a* is perspective view of an antenna unit using a metal wall for isolation between two microstrip array antennas, in accordance with the prior art.
Figure 1B:
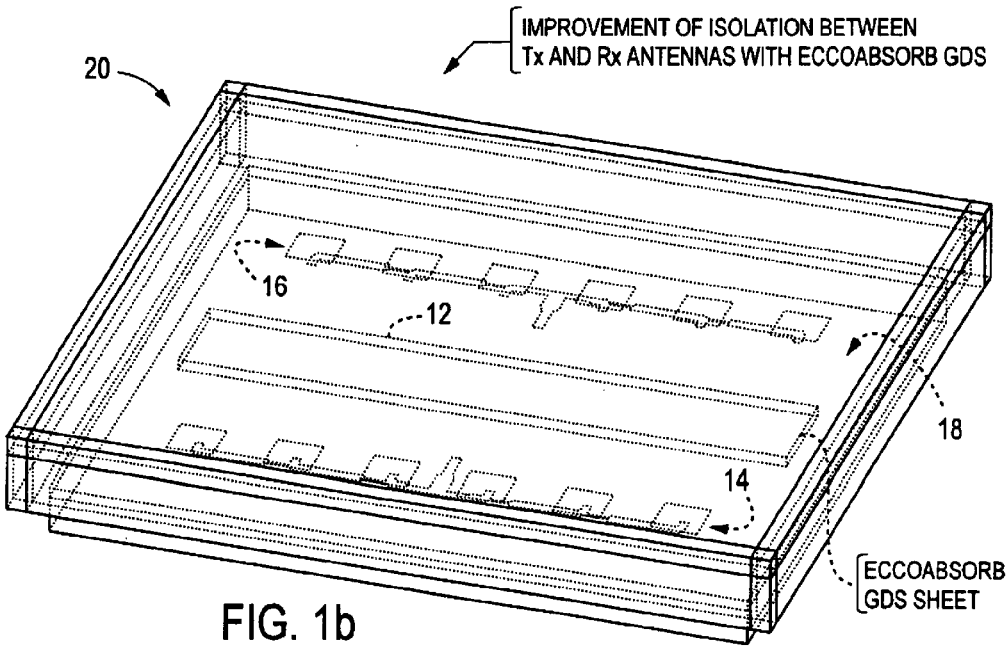
FIG. 1b PRIOR ART
FIG. 1*b* is perspective view of an antenna unit using a section of Eccosorb GDS material for isolation between two microstrip array antennas, in accordance with the prior art.
Figure 2:
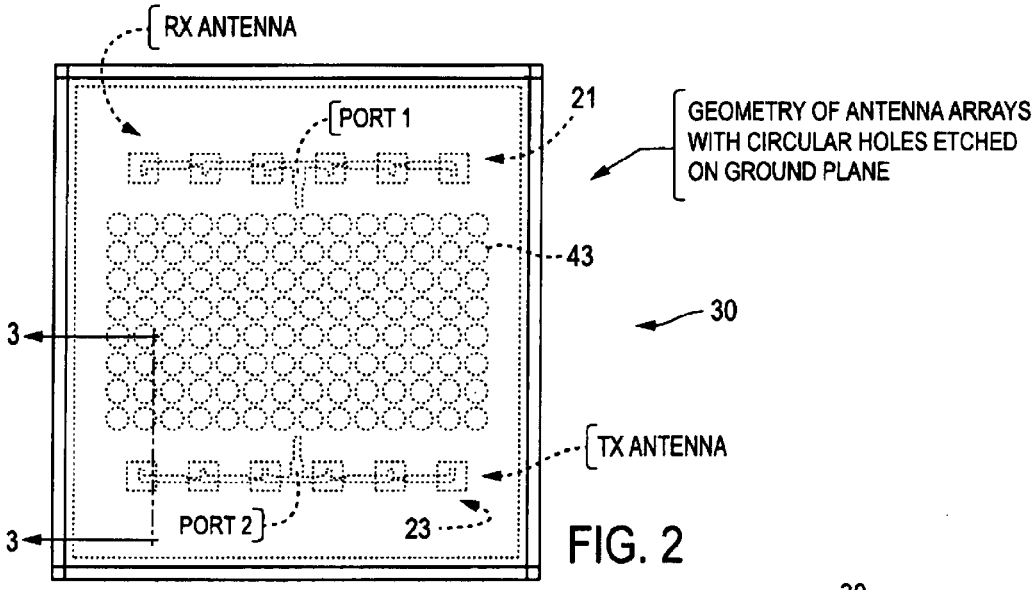
FIG. 2 is a top view of an antenna unit in accordance with the present invention.

Referring to FIG. 2, a top view of a preferred embodiment of an antenna unit 30 in accordance with the present invention is shown. The antenna unit 30 contains a transmit slot-coupled microstrip antenna array (TX antenna) 21 and a receive slot-coupled mictrostrip antenna array (RX antenna) 23. The embodiment illustrated in FIG. 2 contains two slot coupled microstrip antenna arrays, although the invention is not limited to units having two slot-coupled microstrip antenna arrays. The invention may be practiced with antenna units comprising any number of slot coupled microstrip antenna arrays, or comprising any number of other types of microstrip antenna arrays, or units comprising a combination of both.

Figure 3:
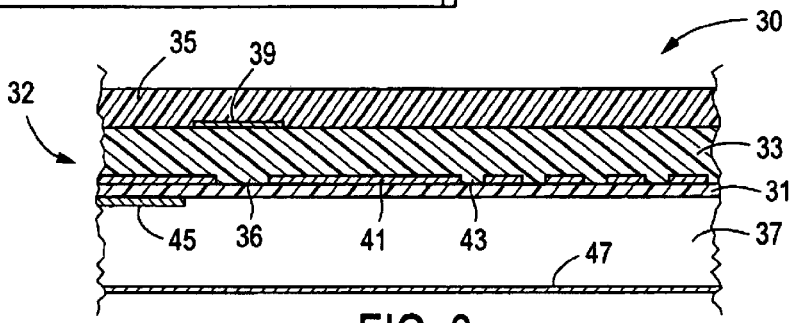
FIG. 3 is a cross-section of the antenna unit shown in FIG. 2 in accordance with the present invention.

FIG. 3 shows a cross-section of the antenna unit layers shown in FIG. 2, as viewed along cut-line 3—3. The elements within the antenna unit 30 are formed on a multilayer substrate 32. Each slot coupled microstrip antenna array comprises a feed microstrip 45 and at least one microstrip patch 39. The feed microstrip 45 is formed on the inside of a first layer 31 of the multilayer substrate 32. In the illustrated embodiment, the first layer 31 comprises a layer of 254 micrometer thick Duriod, although the invention may be practiced with other material types.

A ground plane 41 resides between the first substrate layer 31 and a second substrate layer 33. The ground plane 41 comprises an electrically conductive layer of copper. The second substrate layer 33 of 787.4 micrometer thick FR4 resides on top of the ground plane 41. The FR4 layer 33 acts as a support layer for the Duroid first substrate layer 31. FR4 material is an inexpensive substrate, thus, it is a favored choice as a carrier layer for support, although various other materials could also be used.

A third layer 35 comprising a one millimeter thick radome is formed on the outer surface of the multilayer substrate 30. The radome can be made of any low loss plastic material. Microstrip patches 39 are etched on a very thin dielectric film (e.g., Kapton) affixed either to the top surface of the second substrate (FR4) layer 33 or the bottom surface of the third (radome) layer 35. The second substrate (FR4) layer has openings directly underneath the patches 39 which lowers dielectric loss and thus increases the gain of the antenna.

Figure 4:
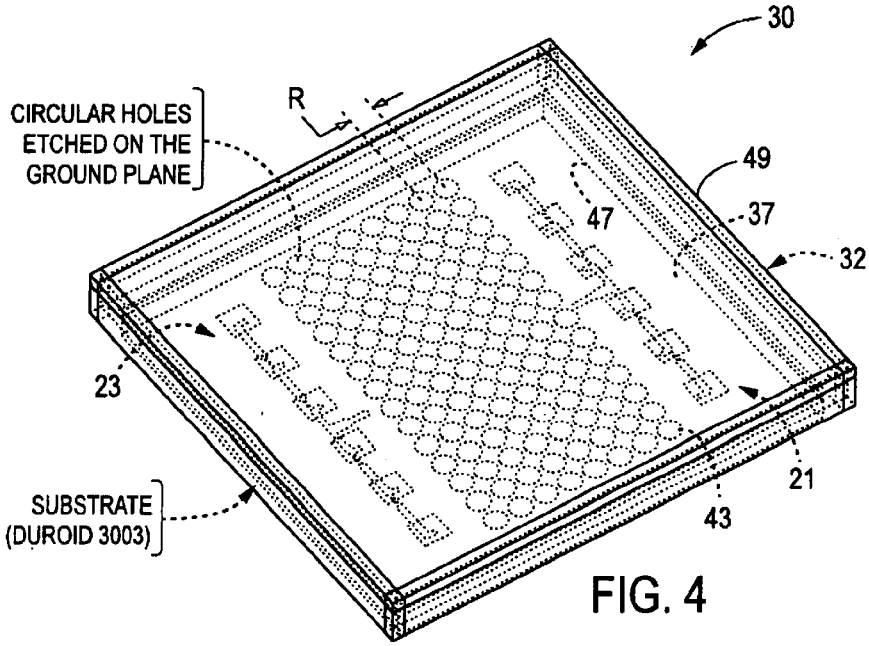
FIG. 4 is a perspective view of an antenna unit in accordance with the present invention.

The multilayer substrate 32 is positioned within the casing of antenna unit such that an air gap 37 exists between the substrate 32 and the rear or floor 47 of the casing that forms the antenna unit 30. The overall shape of the antenna unit is shown in FIG. 4. Referring to FIG. 4, the casing 49 of the antenna unit 30 is formed in the shape of an open-faced box. Preferably, the casing comprises a metal material, which prevents radiation from the slots from traveling backward by acting as a reflector. The multilayer substrate 32 serves to close the box by acting as the front face of the unit 30, creating the air gap 37 between the substrate 32 and the floor 47 of the casing which acts as the rear of the unit 30.

Referring again to FIG. 2, a series of openings are shown situated between the RX antenna 23 and the TX antenna 21. These openings comprise holes 43 etched in the ground plane (41 as shown in FIG. 3) of the antenna unit 30. The holes 43 form periodic stop band filters by suppressing surface waves from the microstrip antenna arrays 21, 23. The period of the filters is determined by the relative spacing of the holes 43 with respect to each other. The stopband center frequency is a function of the period of the structure (i.e., the distance between the rows of holes in the ground plane). The center frequency is approximately velocity divided by twice the period as measured by the distance between the holes. For example, the embodiment illustrated in FIG. 2 comprises a grid pattern of 8 rows each containing 14 holes. The distance between each row is 3.5 millimeters. This results in a center frequency of approximately 24 GHz, which is desired for HRR applications.

The width of the stop band and the attenuation in the stop band are dependent upon the radii of the etched holes 43. For smaller circle radii, the width of the stop band and attenuation are very small. This follows under the theory that, as the radii of the holes 43 approach zero, the stop band width approaches zero. In other words, the stop band disappears when the holes disappear. The preferred range of radii of the holes for 24 GHz applications is between 1 mm and 1.5 mm. In the embodiment shown in FIG. 2, a hole diameter of 1.4 millimeters has been chosen. This provides a stop band sufficiently wide around the critical frequency (24 GHz in a preferred embodiment) to suppress the surface waves and improve the isolation and gain of the antenna. The stop band extends a minimum of 6 GHz on either size of 24 GHz (12 GHz width).

In some applications, RF circuits can be located on the rear side of the first substrate layer 31. Some of these circuits can require a solid ground plane to work properly. This can prevent the openings from being etched on the ground plane 41. In such instances, the openings can be etched on a metalized plane located on the top surface of the second substrate layer 33 on the bottom surface of the third (radome) layer 35. While moving the openings off of the ground plane 41 will cause the performance of the antenna to be reduced, it allows the invention to be practiced in units that contain RF circuitry on the rear side of the first substrate layer 31.

Figure 5A:
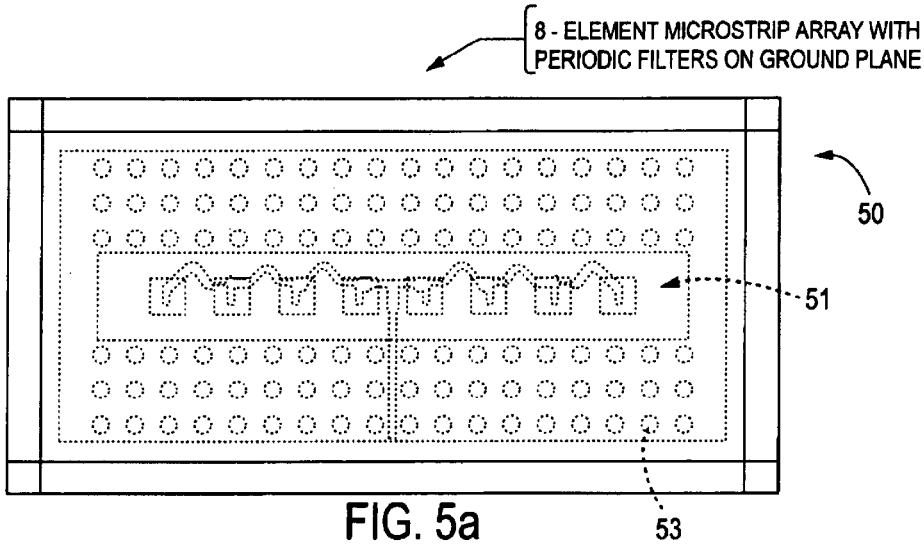
FIG. 5*a* illustrates an antenna unit comprising a slot coupled microstrip antenna array in combination with a series of periodic filters in accordance with an additional embodiment of the present invention.
Figure 5B:
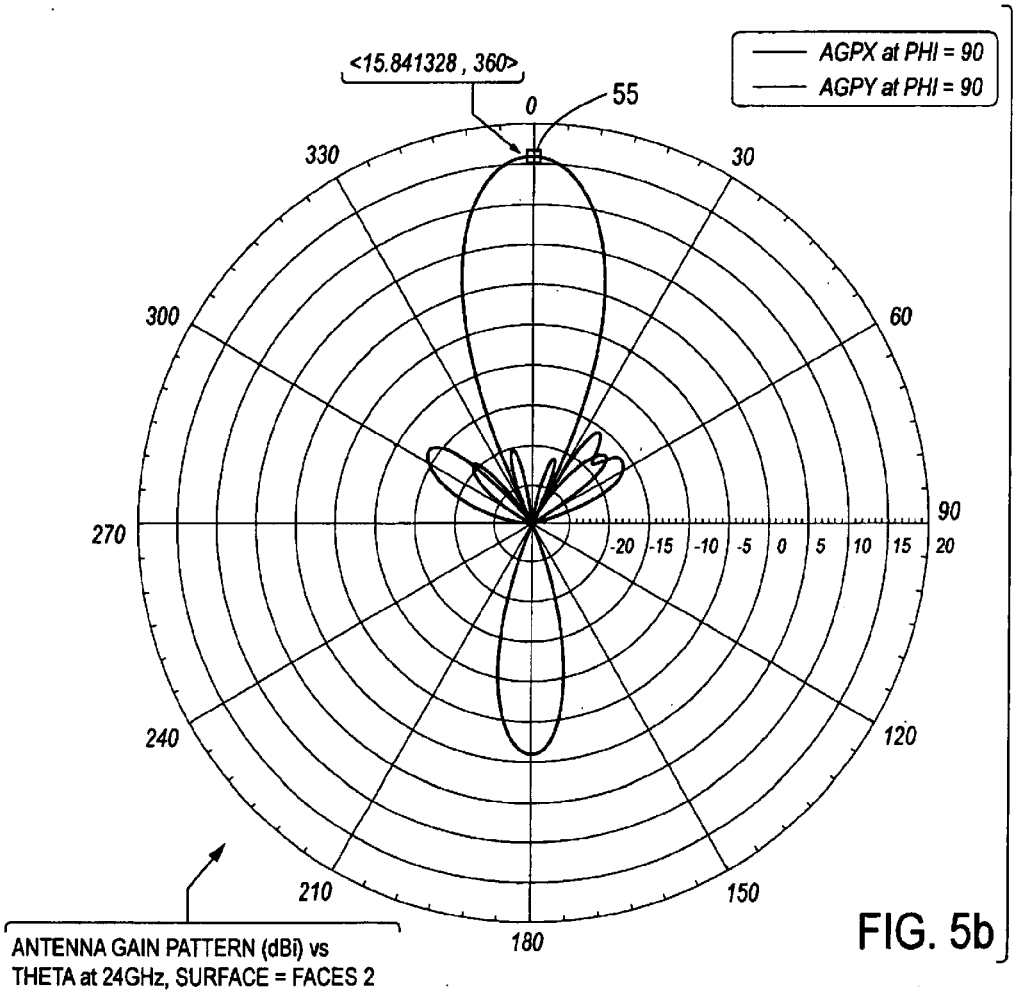
FIG. 5*b* is a graph of the gain pattern achieved using the antenna illustrated in FIG. 5*a*.
Figure 6A:
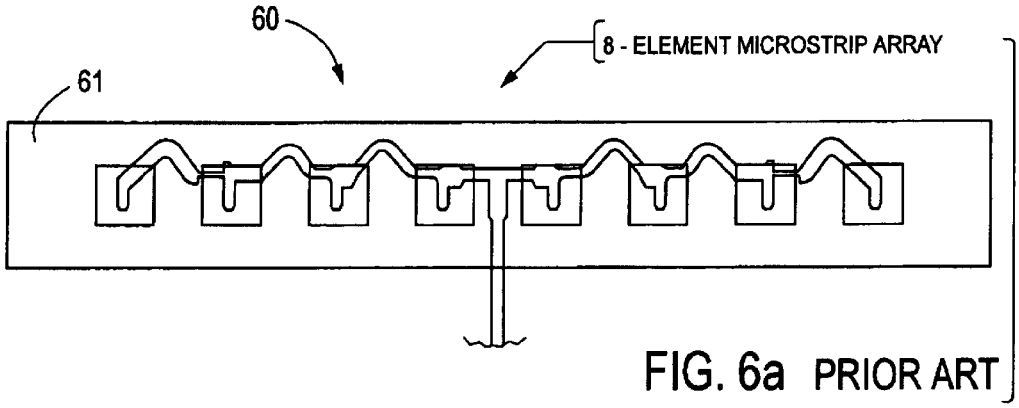
FIG. 6a PRIOR ART
FIG. 6*a* illustrates a comparative antenna unit comprising a slot coupled microstrip antenna array without the addition of periodic filters, in accordance with the prior art.
Figure 6B:
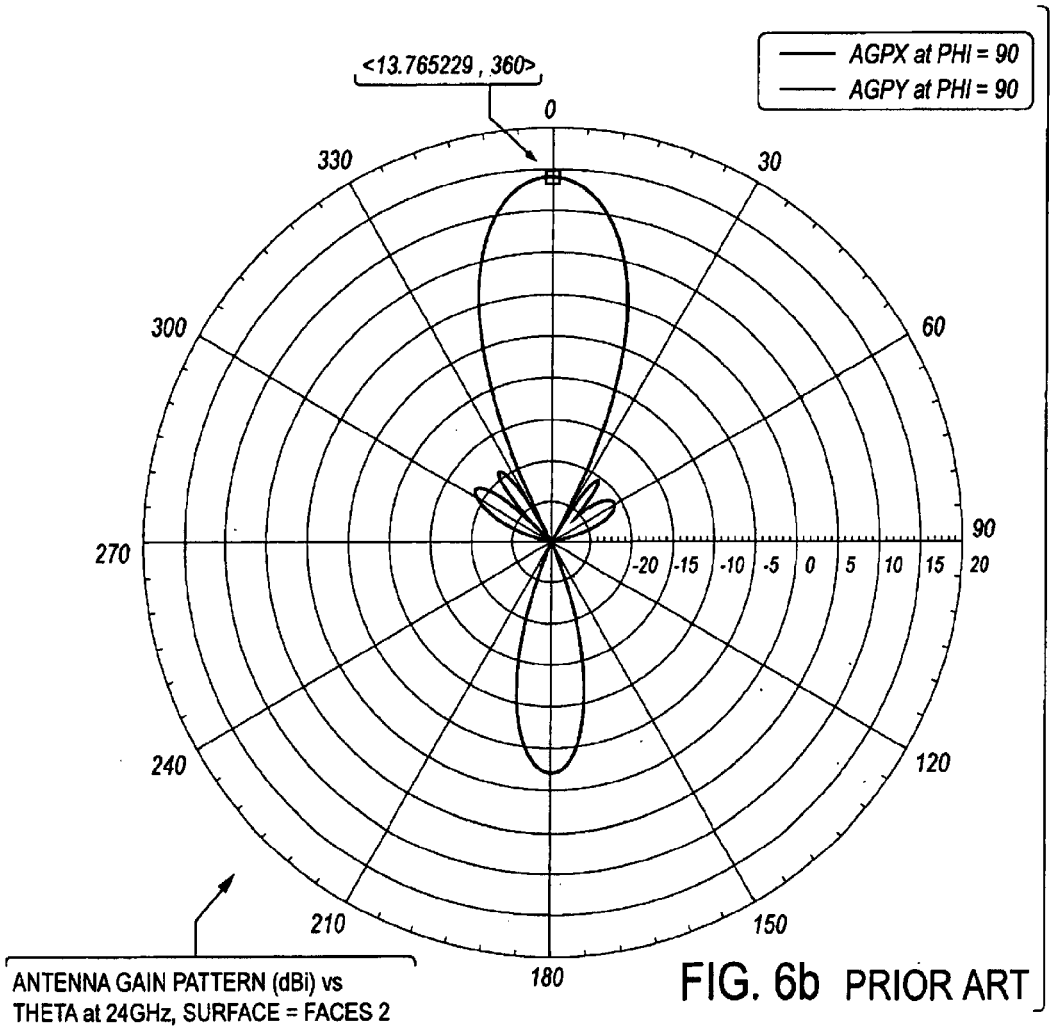
FIG. 6b PRIOR ART
FIG. 6*b* is a graph of the antenna gain pattern achieved using the antenna illustrated in FIG. 6*a*.

A second embodiment of the present invention is shown in FIG. 5*a*. FIG. 5*a* illustrates an antenna unit 50 comprising a single eight-element slot-coupled microstrip antenna array 51. The slot coupled microstrip antenna array 51 is constructed according to the configuration described for the two array embodiment (as shown in FIG. 3). Periodic filters in the form of holes 53 etched in the ground plane reside on both sides of the array 53. Isolation from a second antenna array is not a concern in this embodiment, as the antenna unit 50 contains only a single antenna array 51. However, the periodic filter serve an additional purpose. By suppressing the surface waves generated by the antenna array 51, the gain of the antenna was increased. FIG. 5*b* shows the gain pattern simulated at 24 GHz for the antenna in accordance with the embodiment shown in FIG. 5*a*. In contrast, FIG. 6*a* shows a slot coupled microstrip array antenna 61 without periodic filters etched into the ground plane, with the corresponding gain pattern simulated at 24 GHz shown in FIG. 6*b*. By comparing the two gain patterns, it can be observed that the periodic filters increase the gain of the antenna array. At zero degrees, a computed gain 55 of 15.8 dBi for an antenna unit 50 in accordance with the present invention is compared to a computed gain 65 of 13.8 dBi for an antenna unit 60 that does not have the periodic filters etched in the ground plane. Thus, an increase of about 2 dBi is obtained using holes etched in the ground plane in accordance with the present invention.

The antenna unit in accordance with the present invention suppresses undesired surface waves associated with the uses of slot coupled microstrip antenna arrays by using periodic filters etched into the ground plan. By doing so, an increase in isolation between slot coupled microstrip antenna arrays. In the preferred embodiment illustrated in FIG. 2, two slot coupled microstrip antenna arrays are separated by a distance of 40 millimeters and have a series of rows of filters etched between them, with each row containing 8 filters. Isolation between the antenna arrays (measured between 22 GHz and 26 GHz) was greater than −30 dB for all frequencies within the measured range. It was measured at greater than −40 dB for some frequencies within this range, and greater than −50 dB for other frequencies within this range. In addition, increased gain of the slot coupled antenna arrays occurs over the same frequency range.

It should be understood that the foregoing is illustrative and not limiting and that obvious modifications may be made by those skilled in the art without departing from the spirit of the invention. Accordingly, the specification is intended to cover such alternatives, modifications, and equivalents as may be included within the spirit and scope of the invention as defined in the following claims.

What is claimed is:

1. An antenna unit, comprising:

a ground plane;

a substrate;

a receiving microstrip antenna array formed on said substrate;

a transmitting microstrip antenna array formed on said substrate; and a plurality of periodic filters formed using openings in said ground plane.

2. An antenna unit as set forth in claim 1 wherein said plurality of periodic filters are formed using an etching process.

3. An antenna unit as set forth in claim 1, wherein said openings are circular in shape.

4. An antenna unit as set forth in claim 1, further comprising a casing, wherein said ground plane and said substrate are contained within said casing.

5. An antenna unit as set forth in claim 4, wherein said casing comprises a metal material.

6. An antenna unit as set forth in claim 4, further comprising at least one feed microstrip coupled to said receiving microstrip antenna array or said transmitting microstrip antenna array.

7. An antenna unit as set forth in claim 1, wherein said substrate is a multilayer substrate comprising a first layer and a second layer.

8. An antenna unit as set forth in claim 7, wherein said first layer comprises a laminate material formed from flame retardant woven glass reinforced epoxy resin.

9. An antenna unit as set forth in claim 7, wherein the second layer comprises glass reinforced polytetrafluoroethylene.

10. An antenna unit as set forth in claim 1 wherein said periodic filters provide an isolation between said receiving microstrip antenna array and said transmitting microstrip antenna array of at least −30 dB.

11. An antenna unit as set forth in claim 1 wherein said periodic filters provide an isolation between said receiving microstrip antenna array and said transmitting microstrip antenna array of at least −40 dB.

12. An antenna unit as set forth in claim 1 wherein said periodic filters provide an isolation between said receiving microstrip antenna array and said transmitting microstrip antenna array of at least −50 dB.

13. A antenna unit, comprising:

a ground plane;

a substrate;

at least one microstrip antenna array formed on said substrate;

a plurality of periodic filters etched on said ground plane.

14. An antenna unit as set forth in claim 13, wherein said plurality of periodic filters comprises a plurality of openings etched in said ground plane.

15. An antenna unit as set forth in claim 13, wherein said openings are circular in shape.

16. An antenna unit as set forth in claim 13, further comprising a casing, wherein said ground plane and said substrate are contained within said casing.

17. An antenna unit as set forth in claim 13, wherein said casing comprises a metal material.

18. An antenna unit as set forth in claim 13, wherein the measured gain of said unit is at approximately 2 dBi greater than an identical unit with no periodic filters etched on the ground plane.

19. A method of improving isolation between a plurality of microstrip antenna arrays comprising the steps of:

1) providing a plurality of microstrip antenna arrays on a substrate;

2) providing a ground plane; and 3) forming at least one periodic filter on said ground plane, wherein said filter is located between said plurality of antenna arrays.

20. The method as set forth in claim 19, wherein step 3 comprises the step of:

3.1) etching at least one opening in said ground plane.

21. The method as set forth in claim 19, wherein said openings are circular.

22. A method of improving gain of a microstrip antenna array comprising the steps of:

1) providing at least one microstrip antenna array on a substrate;

2) providing a ground plane; and 3) forming at least one periodic filter in said ground plane.

23. The method as set forth in claim 22, wherein step 3 comprises the step of:

3.1) etching at least one opening in said ground plane.

24. The method as set forth in claim 22, wherein said openings are circular.

25. An antenna unit, comprising:

a ground plane;

a conductive layer;

a substrate positioned between said ground plane and said conductive layer;

a receiving microstrip antenna array formed on said substrate;

a transmitting microstrip antenna array formed on said substrate;

a plurality of periodic filters formed using openings in said conductive layer.

* * * * *